US010421653B2

(12) United States Patent
Poczciwinski

(10) Patent No.: US 10,421,653 B2
(45) Date of Patent: Sep. 24, 2019

(54) PORTABLE MANHOLE COVER MOVING ASSEMBLY AND METHOD FOR MOVING A MANHOLE COVER

(71) Applicant: Thomas Poczciwinski, Barker, NY (US)

(72) Inventor: Thomas Poczciwinski, Barker, NY (US)

( * ) Notice: Subject to any disclaimer, the term of this patent is extended or adjusted under 35 U.S.C. 154(b) by 242 days.

(21) Appl. No.: 15/687,117

(22) Filed: Aug. 25, 2017

(65) Prior Publication Data

US 2018/0057334 A1 Mar. 1, 2018

Related U.S. Application Data

(60) Provisional application No. 62/379,836, filed on Aug. 26, 2016.

(51) Int. Cl.

| | |
|---|---|
| ***B66F 19/00*** | (2006.01) |
| ***B66C 1/14*** | (2006.01) |
| ***B66C 23/44*** | (2006.01) |

(52) U.S. Cl.

CPC ..... *B66F 19/005* (2013.01); *B66C 1/14* (2013.01); *B66C 23/44* (2013.01)

(58) Field of Classification Search

CPC ..... B66C 1/14; B66C 23/44; B66F 19/005
See application file for complete search history.

(56) References Cited

U.S. PATENT DOCUMENTS

| | | | | |
|---|---|---|---|---|
| 323,352 A * | 7/1885 | Meltzer | B65G 41/002 | 198/861.4 |
| 1,551,132 A * | 8/1925 | Butler | B66C 23/36 | 212/345 |
| 1,558,636 A * | 10/1925 | Rutan | B66C 23/208 | 212/263 |
| 1,887,965 A * | 11/1932 | Stoner | B66C 23/48 | 212/345 |
| 3,152,708 A * | 10/1964 | Agesen | B66F 19/005 | 254/132 |
| 4,710,090 A * | 12/1987 | DeLuca | B66C 23/44 | 212/238 |
| 4,789,072 A * | 12/1988 | Quam | B66C 1/06 | 212/166 |
| 5,022,489 A * | 6/1991 | Sauber | A62B 1/00 | 182/145 |

(Continued)

*Primary Examiner* — Michael E Gallion
(74) *Attorney, Agent, or Firm* — Vincent G. LoTempio; Kloss, Stenger & LoTempio; David T. Stephenson

(57) ABSTRACT

A manhole cover moving assembly and method for moving a manhole cover works to lift, lower, rotate, extend, retract, and laterally displace a manhole cover over a short distance and in difficult to access areas. The moving assembly detachably attaches a hitch to a mobile mount for portability. The moving assembly provides a mast and a shaft that operate at adjustable relative to create mechanical advantages while moving the manhole cover. A telescoping support arm adjusts the angle of the shaft relative to the mast. The shaft carries a pulley apparatus and a cable that suspends the manhole cover. The mast rotates about a hitch. The shaft pivots about the mast. The shaft also extends and retracts. Further, as the angle of the shaft is changed through manipulation of the telescoping support arm, the mechanical advantage is increased for facilitating movement of the manhole cover.

19 Claims, 18 Drawing Sheets

(56) References Cited

U.S. PATENT DOCUMENTS 5,035,336 A * 7/1991 Schmitz ..... B66C 1/06 212/166
5,165,661 A * 11/1992 Wright ..... B66F 15/00 254/131
5,205,700 A * 4/1993 Lin ..... A61G 3/0209 414/540
5,211,297 A * 5/1993 Vandervalk ..... B66C 23/42 212/179
5,211,526 A * 5/1993 Robinette ..... B60P 1/5471 212/238
5,431,526 A * 7/1995 Peterson ..... B60P 1/5433 212/223
5,445,487 A * 8/1995 Koscinski, Jr. ..... B60P 1/5433 212/232
5,462,385 A * 10/1995 Mohlengraft ..... B66F 15/00 254/131
5,725,112 A * 3/1998 Thorby ..... B66C 23/44 212/180
5,749,697 A * 5/1998 Davis ..... B66C 23/44 212/253
5,752,799 A * 5/1998 Carey ..... B60P 1/5471 224/403
5,775,674 A * 7/1998 Bigham ..... B66F 15/00 254/130
5,993,137 A * 11/1999 Harr ..... B60P 1/5433 212/238
6,030,170 A * 2/2000 Lewis ..... B66C 23/44 212/202
6,050,548 A * 4/2000 Leger ..... B66C 23/48 254/326
6,478,528 B1 * 11/2002 Asbury ..... B60P 1/548 212/180
6,520,482 B1 * 2/2003 Bigham ..... B66F 19/005 254/131
6,554,254 B2 * 4/2003 Vetesnik ..... A62B 1/06 254/325
6,830,423 B1 * 12/2004 Williams ..... B60P 1/5471 212/180
6,899,238 B2 * 5/2005 Austin ..... B66C 23/166 212/175
6,945,742 B2 * 9/2005 Roberts ..... B62B 1/002 212/166
7,172,083 B1 * 2/2007 Raines ..... B60P 1/5423 212/261
7,213,715 B2 * 5/2007 Boily ..... A62B 1/08 212/179
7,293,759 B2 * 11/2007 Beach ..... B66F 19/005 254/120
7,604,450 B1 * 10/2009 Calvery ..... B66C 23/44 212/180
7,699,292 B2 * 4/2010 Barnett ..... B66C 23/20 212/292
9,434,582 B2 * 9/2016 Arthur ..... B66C 23/00
9,630,816 B1 * 4/2017 Napieralski ..... B66C 23/06
2003/0235487 A1 * 12/2003 Roberts ..... B62B 1/002 414/490
2004/0042886 A1 * 3/2004 Roberts ..... B62B 1/002 414/607
2009/0095944 A1 * 4/2009 Gaines ..... B66C 23/005 254/334

* cited by examiner

PORTABLE MANHOLE COVER MOVING ASSEMBLY AND METHOD FOR MOVING A MANHOLE COVER

CROSS REFERENCE OF RELATED APPLICATIONS

This application claims the benefits of U.S. provisional application No. 62/379,836, filed Aug. 26, 2016 and entitled MANHOLE COVER MOVING ASSEMBLY, which provisional application is incorporated by reference herein in its entirety.

FIELD OF THE INVENTION

The present invention relates generally to a portable manhole cover moving assembly and method for moving a manhole cover. More so, a moving assembly is configured to lift, lower, rotate, extend, retract, and laterally displace a manhole cover over a short distance and in difficult to access areas; whereby the moving assembly detachably attaches a hitch to a mobile mount for portability; whereby the moving assembly provides a mast and a shaft that operate at adjustable relative to create mechanical advantages while moving the manhole cover; whereby a telescoping support arm adjusts the angle of the shaft relative to the mast; whereby the shaft carries a pulley apparatus and a cable that suspends the manhole cover; whereby the mast rotates about a hitch; whereby the shaft pivots about the mast; whereby the shaft also extends and retracts; whereby as the angle of the shaft is changed through manipulation of the telescoping support arm, the mechanical advantage is increased for facilitating movement of the manhole cover.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, manhole covers frequently weigh five hundred pounds and upward. Because of their weight and unwieldy size, difficulties are encountered in lifting and removing the manhole covers. Likewise, the fit between the cover and the manhole may be tight, jammed or wedged, making it difficult to loosen or move. Often, a person lifting a manhole cover with conventional equipment such as crowbars, hooks and the like, must stand close to the manhole cover. Consequently there is a considerable risk of falling into the manhole.

Also, the sheer weight of a manhole cover may over-strain a man, or a sudden jerk or pull may cause internal damage and injury. It has long been recognized by safety engineers that such lifting and removing and replacing of manhole covers, constitutes an industrial hazard. The present invention helps solve the problems associated with manual lifting of manhole covers to lower fatigue and back injury.

Typically, machines consist of a number of elements, such as gears and ball bearings that work together in a complex way. Nonetheless, no matter how complex they are, all machines are based in some way on six types of simple machines. These six types of machines are the lever, the wheel and axle, the pulley, the inclined plane, the wedge, and the screw.

It is known that in machines that transmit mechanical energy, the ratio of the force exerted by the machine to the force applied to the machine is known as mechanical advantage. Under mechanical advantage the distance the load will be moved will be only be a fraction of the distance through which the effort is applied. Simple machines can be adjusted, moved, and manipulated to increase the mechanical advantages necessary to move manhole cover Other proposals have involved leveraging mechanical energy to displace a manhole cover. The problem with these moving devices is that they are not portable. Also, they do not lift, lower, rotate, extend, retract, and laterally displace a manhole cover over a short distance and in difficult to access areas. Even though the above cited moving devices meet some of the needs of the market, a portable manhole cover moving assembly and method for moving a manhole cover to lift, lower, rotate, extend, retract, and laterally displace a manhole cover over a short distance and in difficult to access areas is still desired.

SUMMARY

Illustrative embodiments of the disclosure are generally directed to a portable manhole cover moving assembly and method for moving a manhole cover. The portable manhole cover moving assembly is portable, detachably hitching to a mobile mount, such as a vehicle, or a portable counterbalance stand for operation. The portable manhole cover moving assembly is configured to efficiently lift, lower, rotate, extend, retract, and laterally displace a manhole cover over a short distance and in difficult to access areas.

The moving assembly uses multiple simple machines to create mechanical advantage while moving the manhole cover. The moving assembly provides a mast and a shaft that operate at adjustable relative to create mechanical advantages. A telescoping support arm adjusts the angle of the shaft relative to the mast. The shaft carries a pulley apparatus and a cable that suspends the manhole cover. The mast rotates about a hitch. The shaft pivots about the mast. The shaft also extends and retracts. Further, as the angle of the shaft is changed through a telescoping support arm, the mechanical advantage is increased for facilitating movement of the manhole cover.

The portable manhole cover moving assembly comprises a hitch that detachably attaches the assembly to a mobile mount. The assembly further comprises a sleeve that joins with the hitch. A rotation member is disposed between the hitch and the sleeve. The rotation member enables the sleeve to rotate relative to the hitch.

In one non-limiting embodiment, assembly comprises a mast that is defined by a lower end and an upper end. The lower end of the mast is coupled to the sleeve in a slidable relationship, whereby the mast rotates in the sleeve. In some embodiments, the assembly comprises a shaft defined by a plurality of apertures disposed in a spaced-apart relationship along the length of the shaft. Shaft pivotally joins with the upper end of the mast. A pivot member connects the shaft to the upper end of the mast. The pivot member enables the shaft to pivot in an up-and-down motion relative to the mast.

In one non-limiting embodiment, assembly comprises a telescoping support arm that is defined by a mast end, a shaft end, and a plurality of telescoping holes. The telescoping support arm is disposed at an angle between the mast and the shaft. The telescoping support arm is telescopically extendable and retractable in length. In this manner, the length of the telescoping support arm at least partially dictates the sloped disposition of the shaft relative to the mast. This adjustable angle creates the mechanical advantage for moving the manhole cover.

The mast end of the telescoping support arm is fixedly joined with the mast. The shaft end of the telescoping support arm adjustably joins with the shaft at one of the apertures, such that the selected aperture for joining the shaft end at least partially dictates the sloped disposition of the shaft relative to the mast. A fastener may be used to pass through the selected aperture that forms in the shaft.

In one non-limiting embodiment, assembly comprises a pulley apparatus that joins with the shaft. Pulley apparatus comprising a cable and a wheel that are rotatable about an axle. The wheel guides the cable along the length of shaft. A manhole cover fastening mechanism joins with a cable terminus of the cable.

In a second aspect, the mast rotates in the sleeve between about 0° to 180°.

In another aspect, the sleeve rotates relative to the hitch between about 0 degrees to 90 degrees.

In another aspect, the shaft pivots relative to the mast between about 25° to 45°.

In another aspect, the hitch comprises a 2 inch receiver.

In another aspect, the sleeve comprises a nylon bushing configured to form a snug fit between an inner diameter of the sleeve and the lower end of the mast.

In another aspect, the hitch forms a hitch hole.

In another aspect, the lower end of the mast forms two lower mast holes.

In another aspect, the assembly further comprises a quick-release pin that passes through the two lower mast holes and the hitch hole.

In another aspect, the upper end of the mast comprises an upper mast hole that aligns with one of the apertures that form in the shaft.

In another aspect, the shaft comprises a square steel tubing.

In another aspect, the pulley apparatus detachably attaches to the shaft.

In another aspect, the manhole cover fastening mechanism comprises a carabiner shackle.

In another aspect, the assembly comprises at least one fastening cable attached to the manhole cover fastening mechanism.

In another aspect, the manhole cover fastening mechanism detachably attaches to a manhole cover.

In another aspect, the shaft comprises a shaft terminus.

In another aspect, the shaft terminus joins with an extension attachment.

In another aspect, the extension attachment is configured to extend the length of the shaft about 3.5 feet.

In another aspect, the pulley apparatus comprises a distal wheel operational at the shaft terminus.

In another aspect, the manhole cover fastening mechanism comprises a rigging plate.

In another aspect, the rigging plate is configured to lift a manhole cover using two fixed length cables and two length adjustable cables.

In another aspect, at least one rigging plate hook attaches to the two fixed length cables and the two length adjustable cables.

One objective of the present invention is to provide an assembly for lifting, lowering, and laterally displacing a manhole cover.

Another objective is to provide multiple mechanical advantages for facilitating movement of the manhole cover.

Another objective is to adjust the angles and lengths of the mast and shaft for moving the manhole cover.

Another objective is to leverage a pulley apparatus to manually lift the manhole cover.

Another objective is to provide a mobile vehicle or counter balance stand to carry the hooks in suspension over the manhole cover.

Another objective is to provide an inexpensive to manufacture manhole cover moving assembly.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
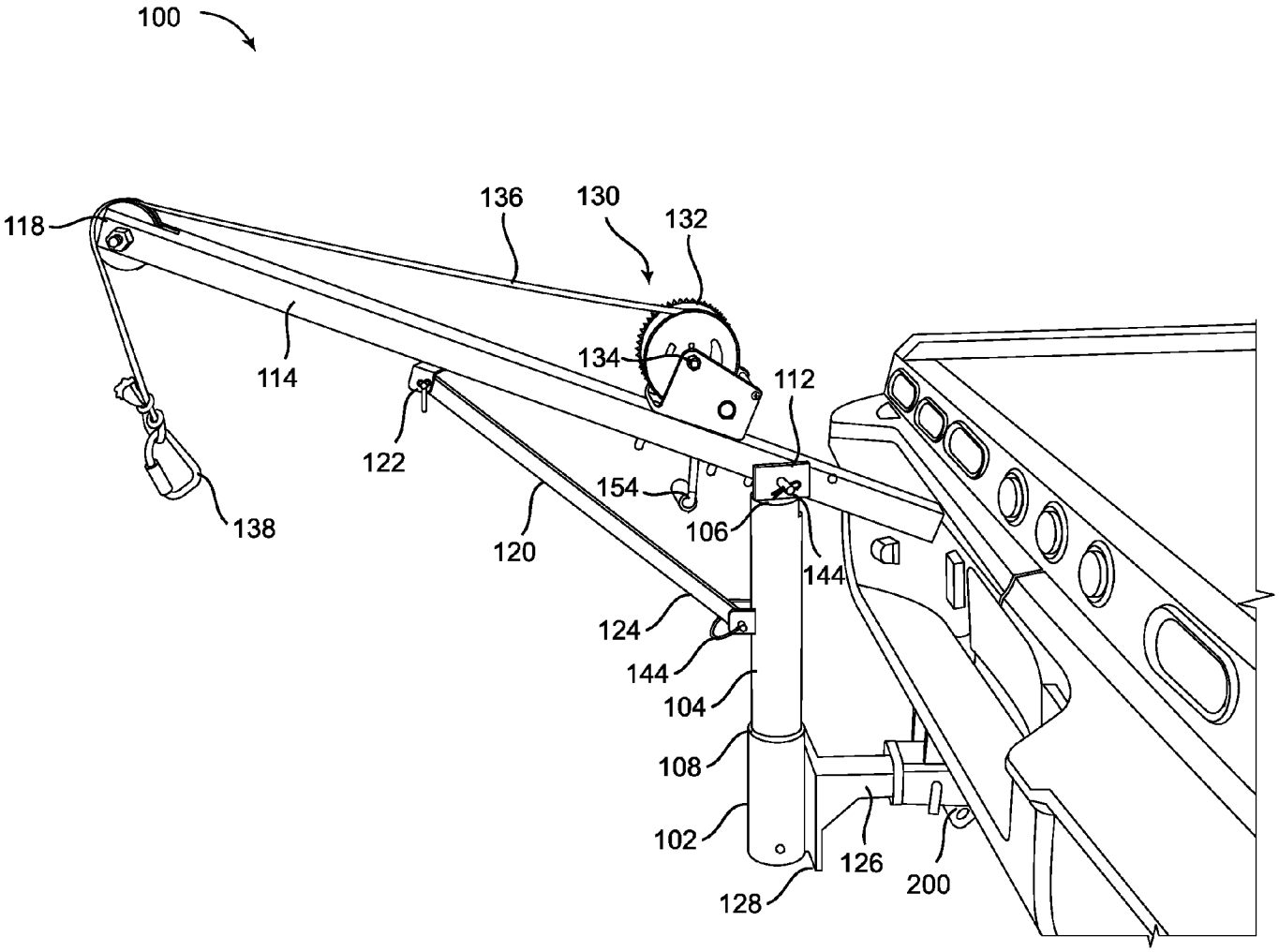
FIG. 1 illustrates a perspective view of an exemplary manhole cover moving assembly hitched to an exemplary mobile mount, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

In one non-limiting embodiment of the present invention presented in FIGS. 1-18, a manhole cover moving assembly 100 and method 300 for moving a manhole cover utilizes simple mechanical advantages through simple levers, pulleys, and cables to efficiently lift, lower, rotate, extend, retract, and laterally displace a manhole cover 202 over a short distance and in difficult to access areas. This unique adjustability changes the magnitude and direction of the lifting force, thereby creating a mechanical advantage. Assembly 100 uses one or more simple machines to create the mechanical advantage and thus move the manhole cover beyond the normal capability of a human. The angle and length adjustability also facilitates access to the manhole cover in difficult locations. Assembly 100 hitches onto a mobile mount 200, such as a vehicle, or a portable counterbalance stand for operation.

Those skilled in the art will recognize that in machines that transmit mechanical energy, the ratio of the force exerted by the machine to the force applied to the machine is known as mechanical advantage. Under mechanical advantage the distance the load, i.e., manhole cover 202, will be moved will be only be a fraction of the distance through which the effort is applied. Thus, the present invention provides various simple machines that can be adjusted, moved, and manipulated to increase the mechanical advantages necessary to move manhole cover 202. Thus, assembly 100 uses multiple simple machines, including a rotatable sleeve 102, a vertical mast 104, a shaft 114 that pivots about the mast 104, a telescoping support arm 120 that adjustably positions shaft 114 about mast 104, and a pulley apparatus 130 and cable 136 to create mechanical advantages for efficiently and easily moving manhole cover 202 over a manhole.

As referenced in FIG. 1, the manhole cover moving assembly 100, hereafter "assembly 100" is configured to be easily moved to different locations with a mobile mount 200. This portability enables assembly 100 to access and move multiple manhole covers in multiple locations. In one embodiment, assembly may detachably hitch to a mobile mount, such as a vehicle, or a portable counterbalance stand for operation.

Thus, the multiple articulations allowed by sleeve 102, mast 104, shaft 114, telescoping support arm 120, and pulley apparatus 130 create mechanical advantages for the cable 136 and a fastening mechanism 138, such as a rigging plate 146, to enable efficient lifting, lowering, rotating, extending, retracting, and laterally displacing manhole cover 202 over a short distance and in difficult to access areas.

Those skilled in the art will recognize that manhole covers frequently weigh five hundred pounds and upward. Because of their weight and unwieldy size, difficulties are encountered in lifting and removing the manhole covers. Likewise, the fit between the cover and the manhole may be tight, jammed or wedged, making it difficult to loosen or move. Often, a person lifting a manhole cover with conventional equipment such as crowbars, hooks and the like, must stand close to the manhole cover. Consequently there is a considerable risk of falling into the manhole. Also, the sheer weight of a manhole cover may over-strain a man, or a sudden jerk or pull may cause internal damage and injury. It has long been recognized by safety engineers that such lifting and removing and replacing of manhole covers, constitutes an industrial hazard. The present invention helps solve the problems associated with manual lifting of manhole covers to lower fatigue and back injury.

Figure 2:
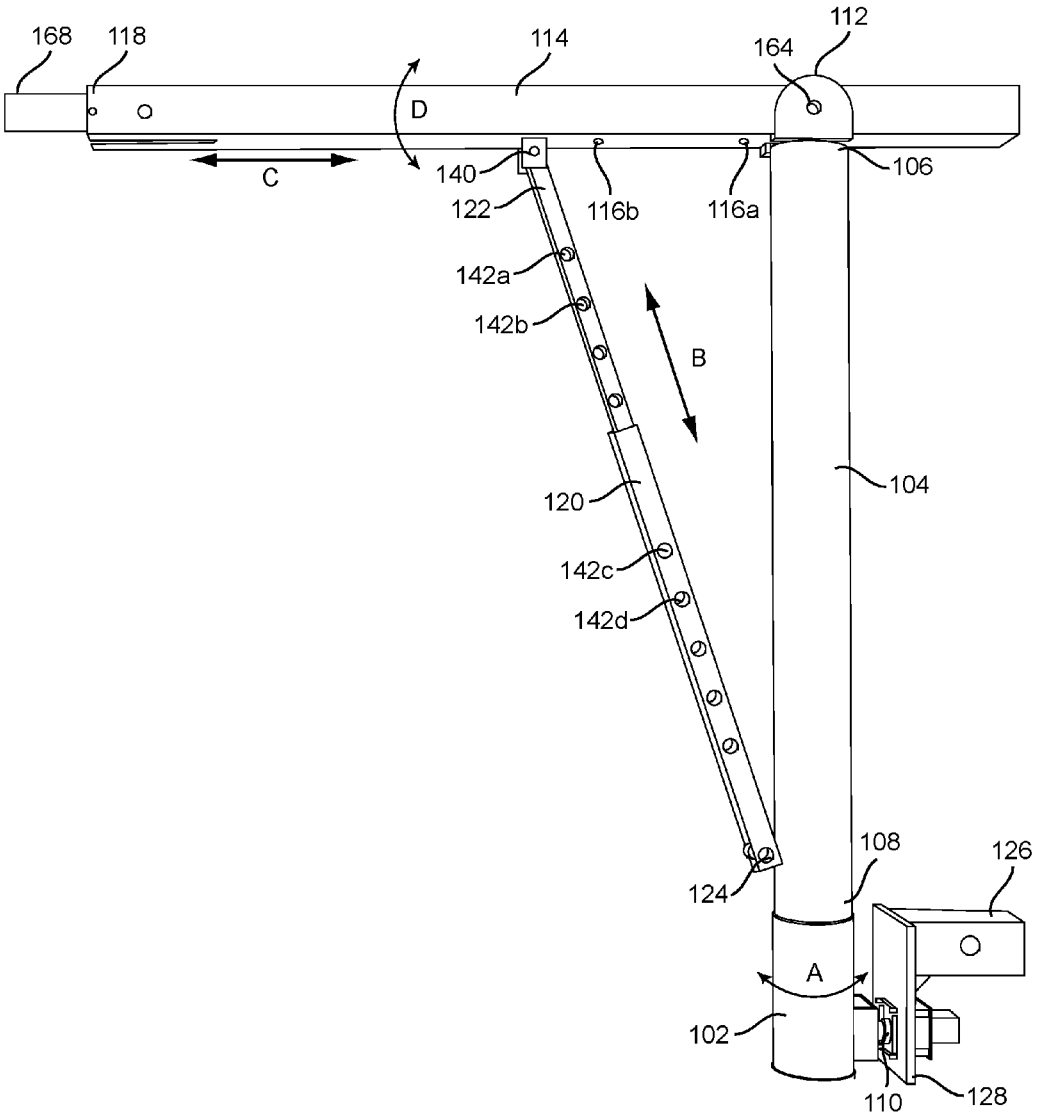
FIG. 2 illustrates an elevated side view of an exemplary hitch, an exemplary mast, an exemplary shaft, and an exemplary adjustment support arm, in accordance with an embodiment of the present invention.

As illustrated in FIG. 2, assembly 100 provides a mast 104 and a shaft 114 that operate at adjustable relative to create mechanical advantages. A telescoping support arm adjusts the angle of the shaft relative to the mast. The shaft carries a pulley apparatus and a cable that suspends the manhole cover. The mast rotates about a hitch. The shaft pivots about the mast. The shaft also extends and retracts. Further, as the angle of the shaft is changed through a telescoping support arm, the mechanical advantage is increased for facilitating movement of the manhole cover.

Figure 3:
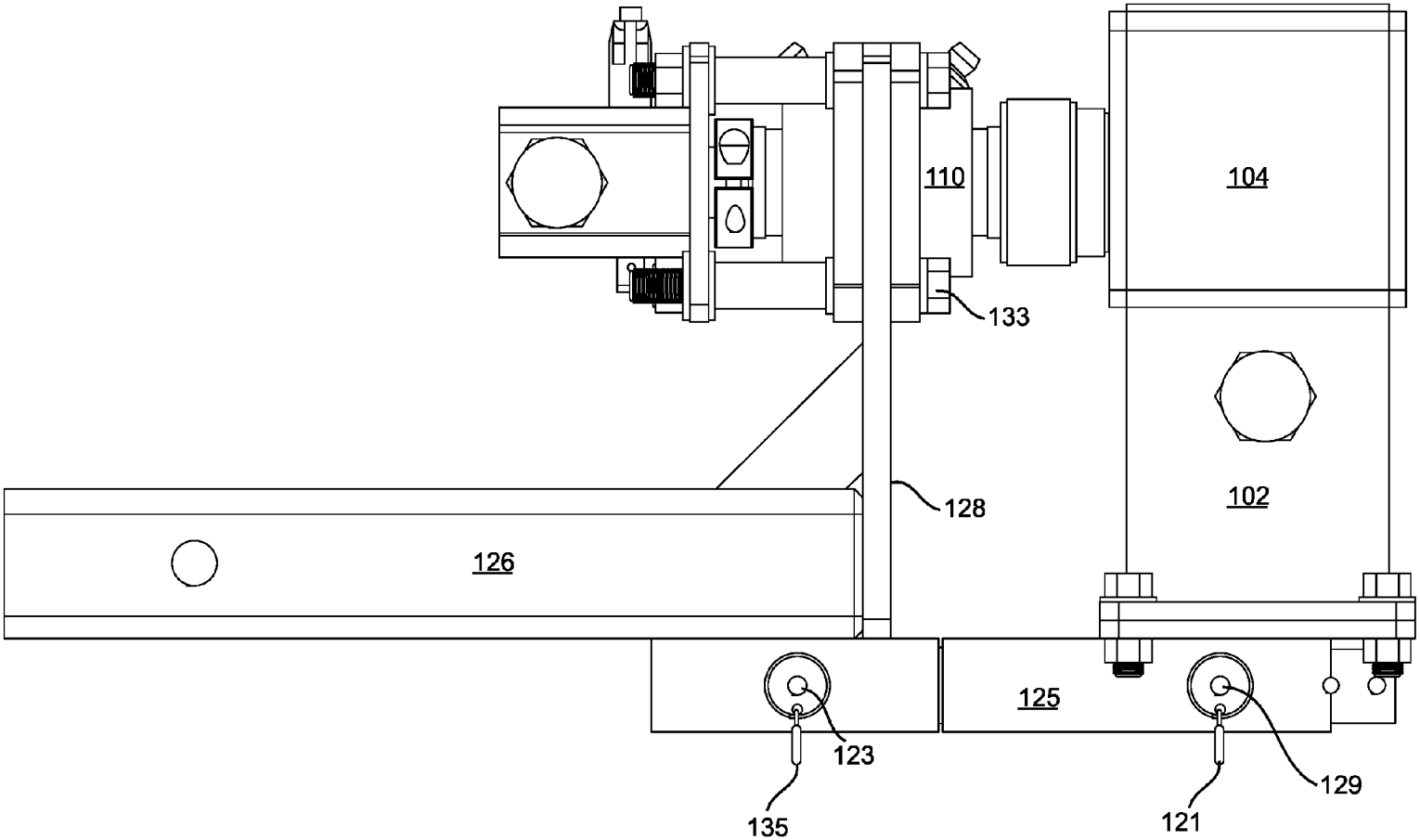
FIG. 3 illustrates a perspective view of an exemplary hitch, in accordance with an embodiment of the present invention.

Turning now to FIG. 3, assembly 100 comprises a hitch 126 that detachably attaches the assembly to a mobile mount 200. Hitch 126 forms a hitch hole 160 through which various fasteners can pass to secure to mobile mount 200. Hitch 126 may include a standard 2" receiver to receive mobile mount 200. Hitch 126 may include a bridge 125 and a fastening rod 127 to connect the sleeve 102 to the hitch 126. Bridge 125 is generally rigid, and extends between sleeve 102 to the hitch 126. Bridge 125 is telescoping to enable extension and retraction by the hitch. A hole 123 in the side of bridge 125 receives a pin 121 for selectively fastening bridge 125 at a desired length. In other embodiments, the hitch 126 detachably attaches the other components of assembly 100 to the vehicle or counterbalance stand. Mobile mount 200 may include, without limitation, a vehicle, a truck, or a portable counterbalance stand. Though any mobile mount sufficiently heavy to counterbalance the weight of the manhole cover may be used.

In one embodiment, mobile mount 200 is a truck (FIG. 1). The truck has sufficient weight to act as a counterbalance to the weight of the manhole cover. The truck is also mobile to move assembly 100 to multiple manhole covers during lifting, lowering, and horizontal movements. In another embodiment, a portable counterbalance stand is used. The portable counterbalance stand has sufficient weight to act as a counterbalance to the weight of the manhole cover. This may be useful in areas where the truck cannot access.

In one embodiment the portable counterbalance stand made is fabricated from aluminum, which is known to have a lighter weight while retaining structural integrity. The portable counterbalance stand comprises a platform for an operator to stand on. In this manner, the weight of the operator forms a part of the counterweight. The portable counterbalance stand further comprises multiple legs that support the platform and form a stable foundation with a ground surface. The legs are height adjustable with spaced-apart leg holes and quick-release pins 144*a-d* that allow for leveling the arms on uneven ground surfaces.

Figure 4:
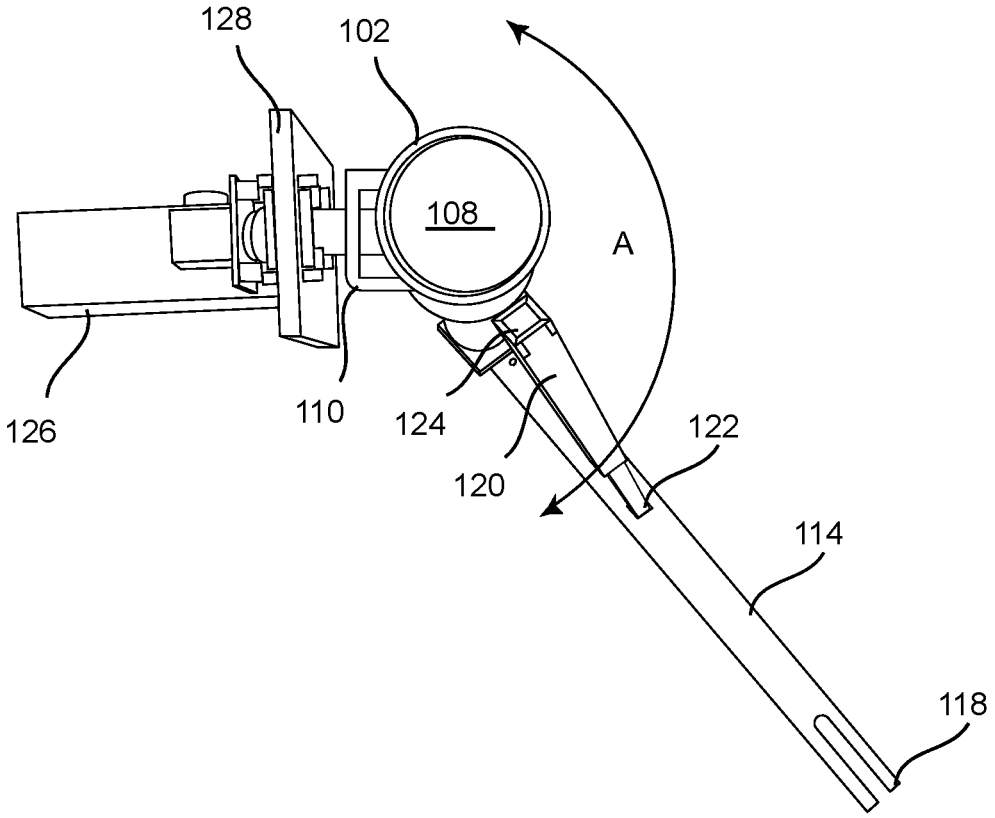
FIG. 4 illustrates a bottom angle view of a manhole cover moving assembly, showing the mast pivoting about the sleeve up to 180°, in accordance with an embodiment of the present invention.

Turning now to FIG. 4, assembly 100 further comprises a sleeve 102 that joins with hitch 126. Sleeve 102 may have a generally cylindrical shape that is sized to rotatably accommodate mast 104 in a snug, friction fit relationship. A rotation member 110 is disposed between hitch 126 and sleeve 102. Rotation member 110 enables sleeve 102 to rotate relative to hitch 126. Rotation member 110 may include a fulcrum, or bearing mechanism known in the art for rotational articulations. In another aspect, sleeve 102 rotates relative to hitch 126 between about 0° to 90°. This rotation allows an operator to rotate assembly 100 out of the way of truck doors or tailgate that open.

Figure 5:
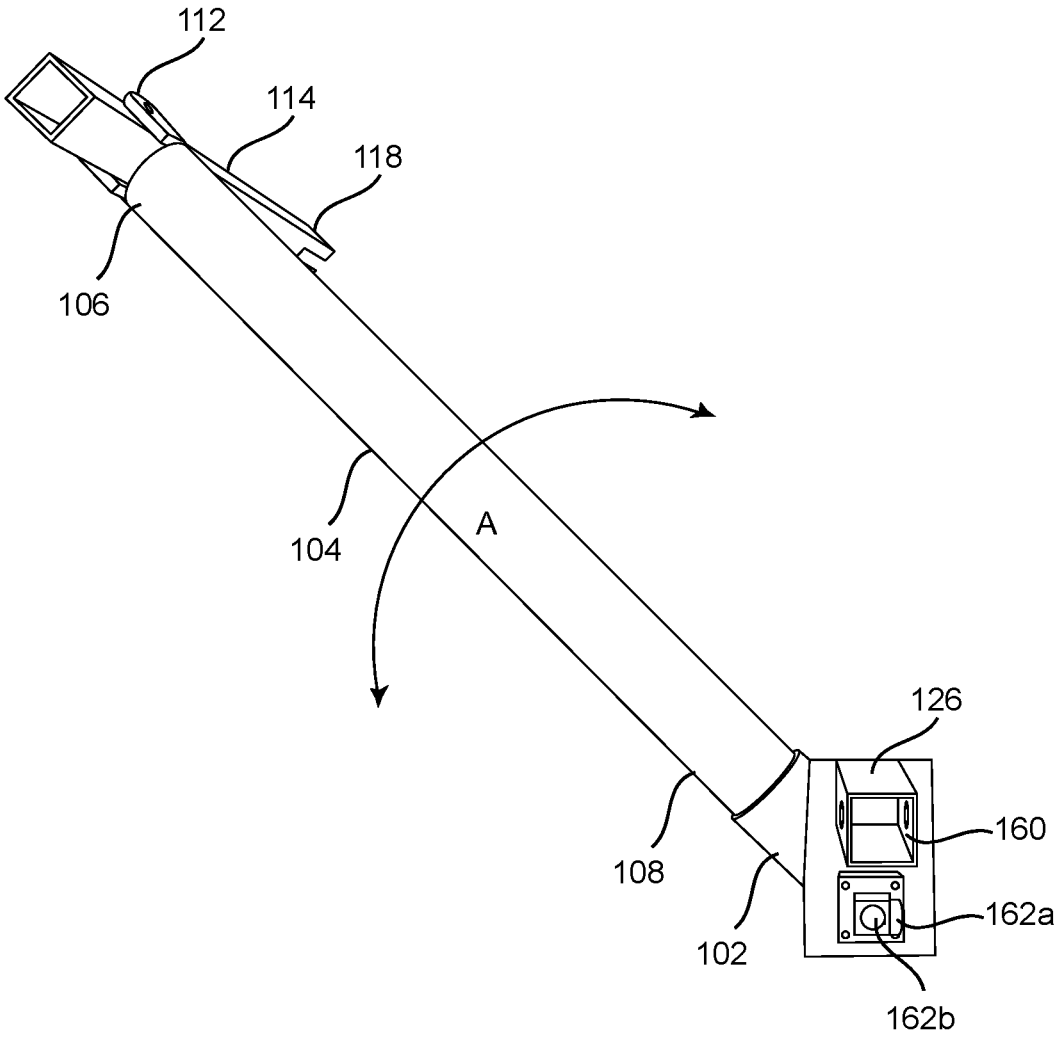
FIG. 5 illustrates a perspective view of the manhole cover moving assembly, showing the mast pivoting about the sleeve up to 180°, in accordance with an embodiment of the present invention.
Figure 6:
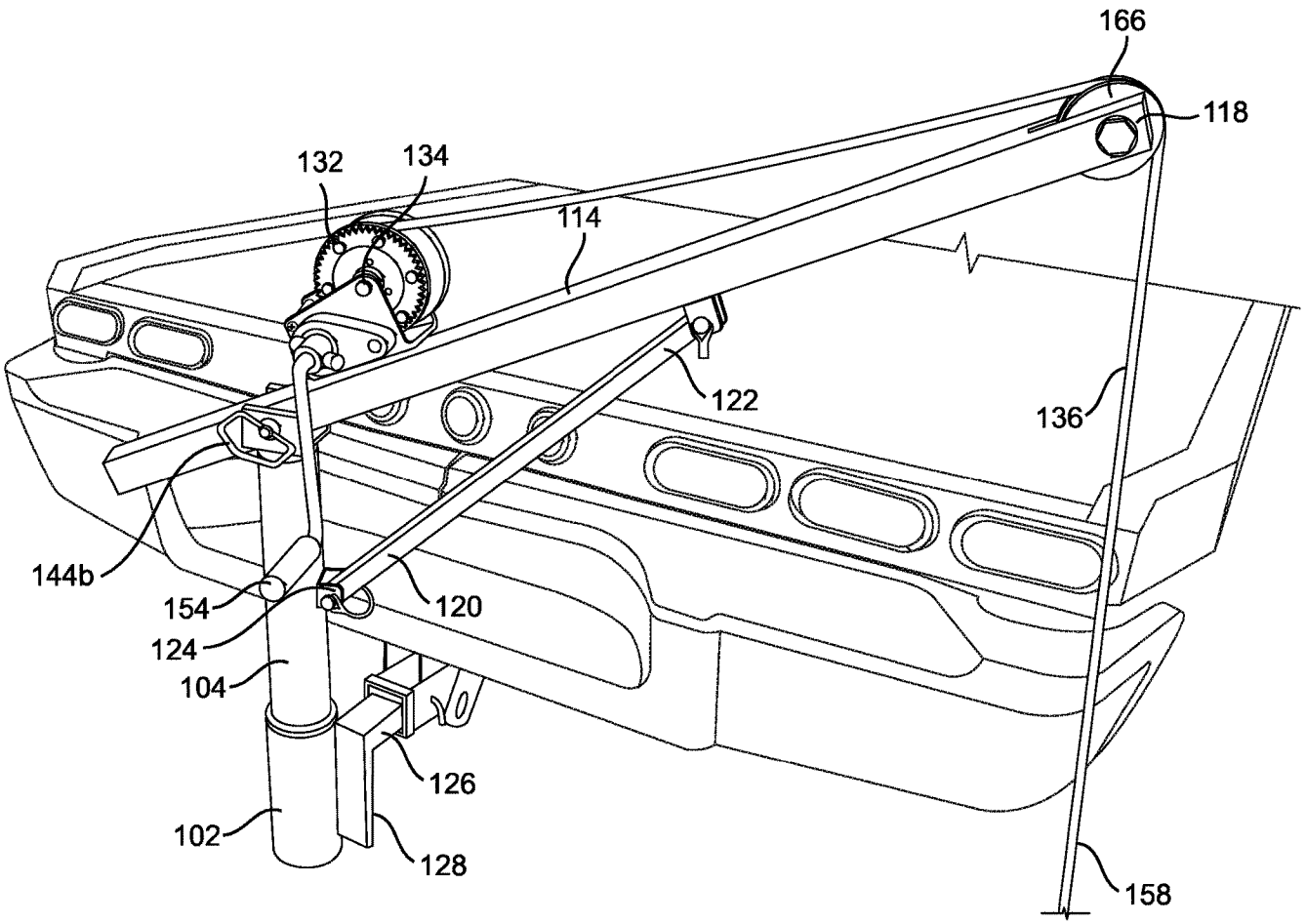
FIG. 6 illustrates a perspective view of a manhole cover moving assembly, showing the mast pivoting about the hitch up to 90°, in accordance with an embodiment of the present invention.

As illustrated in FIG. 5, in addition to the rotational articulation of sleeve 102, the mast 104 rotates inside the sleeve 102 between about 0° to 180°. Though in other embodiments, the rotation of mast 104 within the sleeve 102 may be greater than 180°. This rotation creates great movement of the assembly 100 for moving the manhole cover 202. For example, as shown in FIG. 6, the manhole cover 202 can be rotated to the left or right by simply rotating the mast 104. Sleeve 102 may include a nylon bushing configured to form a snug fit between an inner diameter of the sleeve 102 and the lower end 108 of the mast 104.

In some embodiments, a nylon bushing positions between sleeve 102 and mast 104. The nylon bushing allows mast 104 to rotate inside sleeve 102, even while carrying heavy loads. Those skilled in the art will recognize that nylon bushing properties include: low friction, no lubrication requirements, low rate of wear, close tolerance abilities, and high heat resistance. Thus, the nylon bushing serves to reduce vibrations and creates a snug interaction between sleeve 102 and mast 104.

In one non-limiting embodiment, assembly 100 comprises a mast 104. Mast 104 is disposed at a generally vertical orientation relative to the ground surface. Mast 104 may be defined by a lower end 108 and an upper end 106. Lower end 108 of mast 104 is coupled to sleeve 102 in a slidable relationship, whereby the mast 104 rotates in the sleeve 102. Sleeve 102 has two lower mast holes 162*a*, 162*b* that allow for attachment to hitch hole 160 in hitch 126. At least one quick release pin 144*a*, 144*b*, 144*c*, 144*d* fastens hitch 126 to mast 104 through the holes 160, 162*a-b*. However, other fastening mechanisms, such as bolts, clips, and magnets may be used in place of quick release pin 144*a-d*.

In a further non-limiting embodiment, assembly 100 comprises a shaft 114. Shaft 114 is the generally horizontal component of assembly that pivots about upper end 106 of mast 104. Shaft 114 ends at a shaft terminus 118, which is a distal point of shaft 114, furthest from mast 104. Shaft 114 is defined by a plurality of apertures 116*a*, 116*b*. Apertures 116*a-b* are disposed in a spaced-apart relationship along the length of shaft 114. In one possible embodiment, shaft 114 comprises a square steel tubing.

In yet another non-limiting embodiment, shaft terminus 118 joins with an extension attachment 168 (FIG. 2). Extension attachment 168 extends the length of the shaft 114 about 3.5', so as to further enhance the mechanical advantage for moving manhole cover 202. This is because by extending the length of the side of the shaft 114 which does not have the load, i.e. manhole cover 202, the amount of force perpendicular to the surface is increased dramatically. Thus, by increasing amount of force perpendicular to the surface, it is possible to increase the work done without any more force applied to the shaft 114, pulley apparatus 130, or cable 136. Also, increasing the length of shaft 114 helps to access a manhole cover 202 in a difficult to access place.

Figure 7:
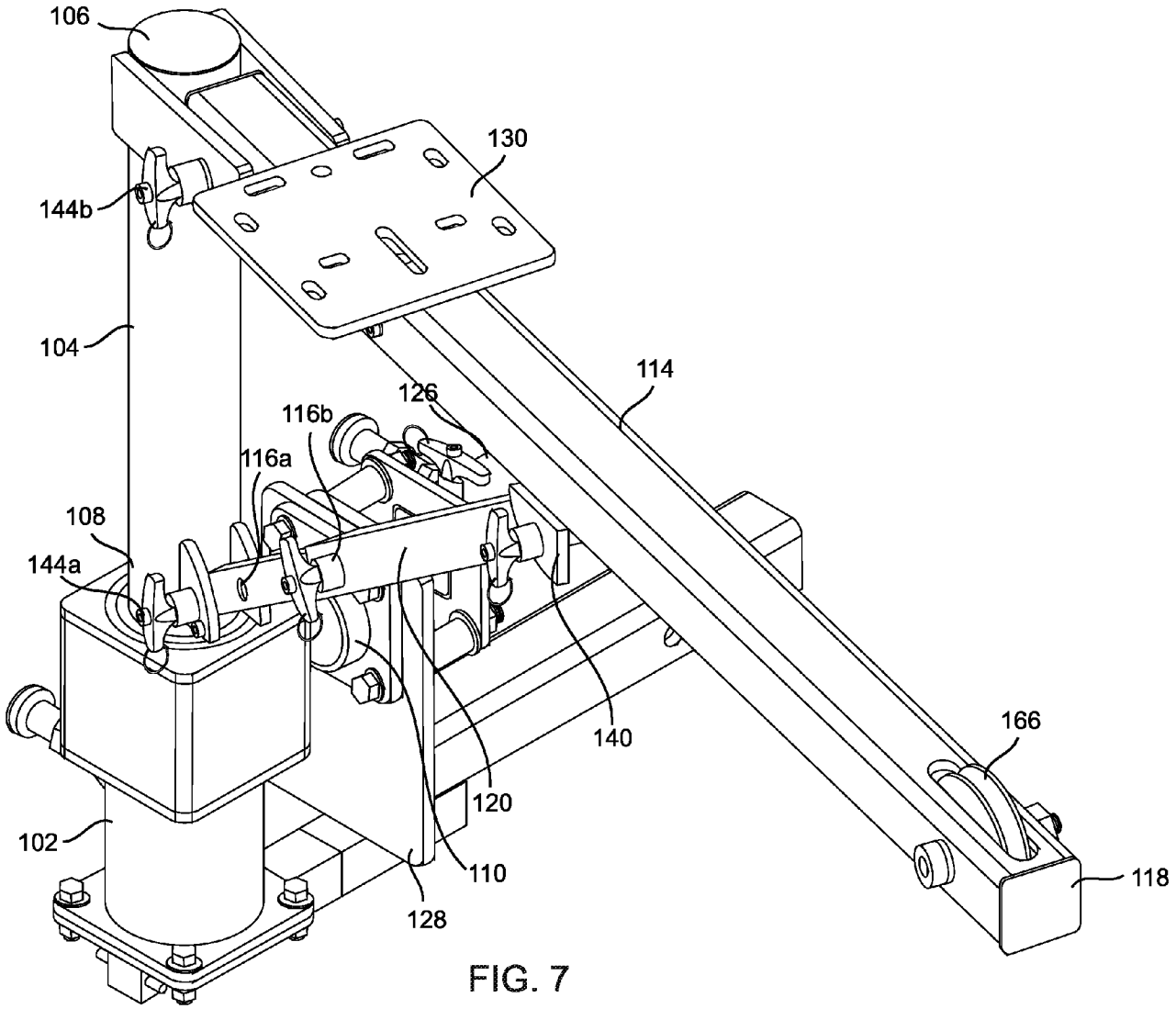
FIG. 7 illustrates a perspective view of a shaft pivoting in relation to a mast, in accordance with an embodiment of the present invention.

In one non-limiting embodiment shown in FIG. 7, a pivot member 112 connects shaft 114 to the upper end 106 of mast 104. In this manner, shaft 114 pivotally joins with upper end 106 of the mast 104. Pivot member 112 enables shaft 114 to pivot in an up-and-down motion relative to the mast 104. In one embodiment, shaft 114 pivots relative to mast 104 between about 25° to 45°. The angle of shaft 114 can be adjusted through various means to decrease the load on cables carrying the manhole cover. It is significant to note that moving the pivot point at the shaft 114 can form the longest side opposite to the side with the manhole cover 202. This creates further mechanical advantage.

Figure 8:
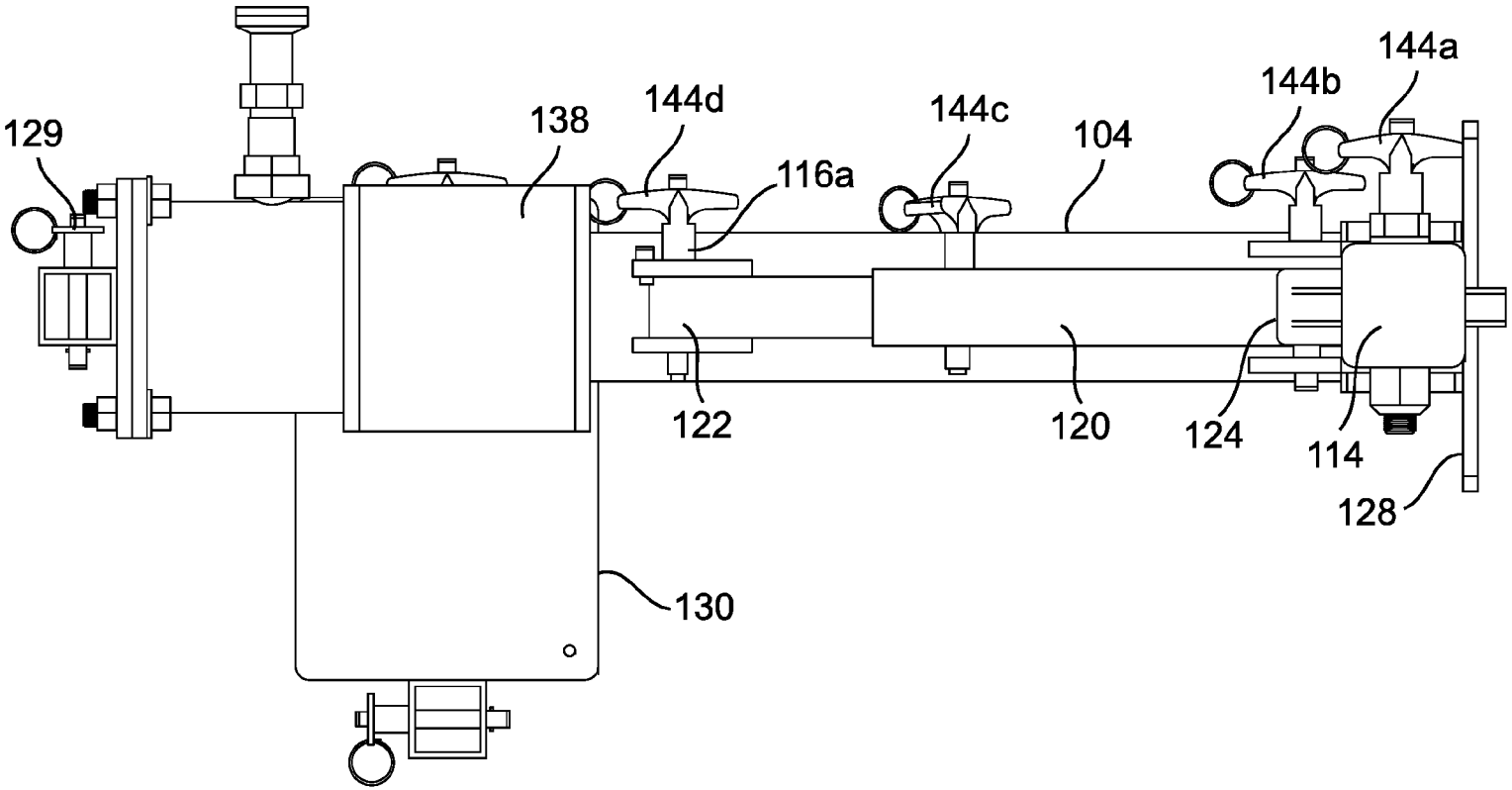
FIG. 8 illustrates a top view of a manhole cover moving assembly, in accordance with an embodiment of the present invention.

Looking now at FIG. 8, assembly 100 comprises a telescoping support arm 120. Telescoping support arm 120 is defined by a mast end 124, a shaft end 122, and a plurality of telescoping holes 142*a*, 142*b*, 142*c*. Telescoping support arm 120 is disposed at an angle between mast 104 and shaft 114. Telescoping support arm 120 is configured to be telescopic, so as to extend and retract in length. Thus, both the angle and the length of the telescoping support arm 120 can be manipulated to achieve a desired fixed position for shaft 114.

In this manner, the adjustable length of telescoping support arm 120 and selection of an aperture 116*a-b* for alignment with hole 140 enables the angle of telescoping support arm 120 to be fixed at a desired angle. This at least partially dictates the sloped disposition of shaft 114 relative to mast 104. The axial and lateral rotation of mast 104 provide even greater mechanical advantages for leveraging the weight of the manhole cover 202.

Thus, the angle and the length of telescoping support arm 120 can be manipulated to achieve a desired fixed position for shaft 114. In this manner, the adjustable length of telescoping support arm 120 and selection of an aperture for alignment with the hole enable the angle of the telescoping support arm 120 to be altered. And changing the angle of the telescoping support arm 120 pivots shaft 114 to a fixed position for optimal mechanical advantage. Further, the axial and lateral rotation of mast 104 provide even greater mechanical advantages to leveraging the weight of manhole cover 202.

As shown back in FIG. 2, a hole 140 that forms in the shaft end 122 of telescoping support arm 120 is aligned with one of the apertures 116*a-b* disposed along the length of shaft 114. Selective alignment of hole 140 in the telescoping support arm 120 with the apertures 116*a-b* of the shaft 114 enables the angle of the shaft 114 to be changed in relation to the mast 104. The selected aperture 116*a* for joining shaft end 122, at least partially, dictates the sloped disposition of shaft 114 relative to mast 104.

For example, selecting to align the hole 140 with an aperture 116*a-b* disposed proximally to the shaft terminus 118 of shaft 114 lowers the angle of shaft 114 relative to mast 104. Conversely, selecting to align hole 140 with aperture 116*a-b* disposed distally from the shaft terminus 118 increases the angle of shaft 114 relative to mast 104. A fastener may be used to pass through the aligned aperture 116*a-b* and hole 140, so as to fasten the shaft 114 at a fixed position relative to the mast 104. The fastener may include at least one quick-release pin 144*a-d*.

Figure 9:
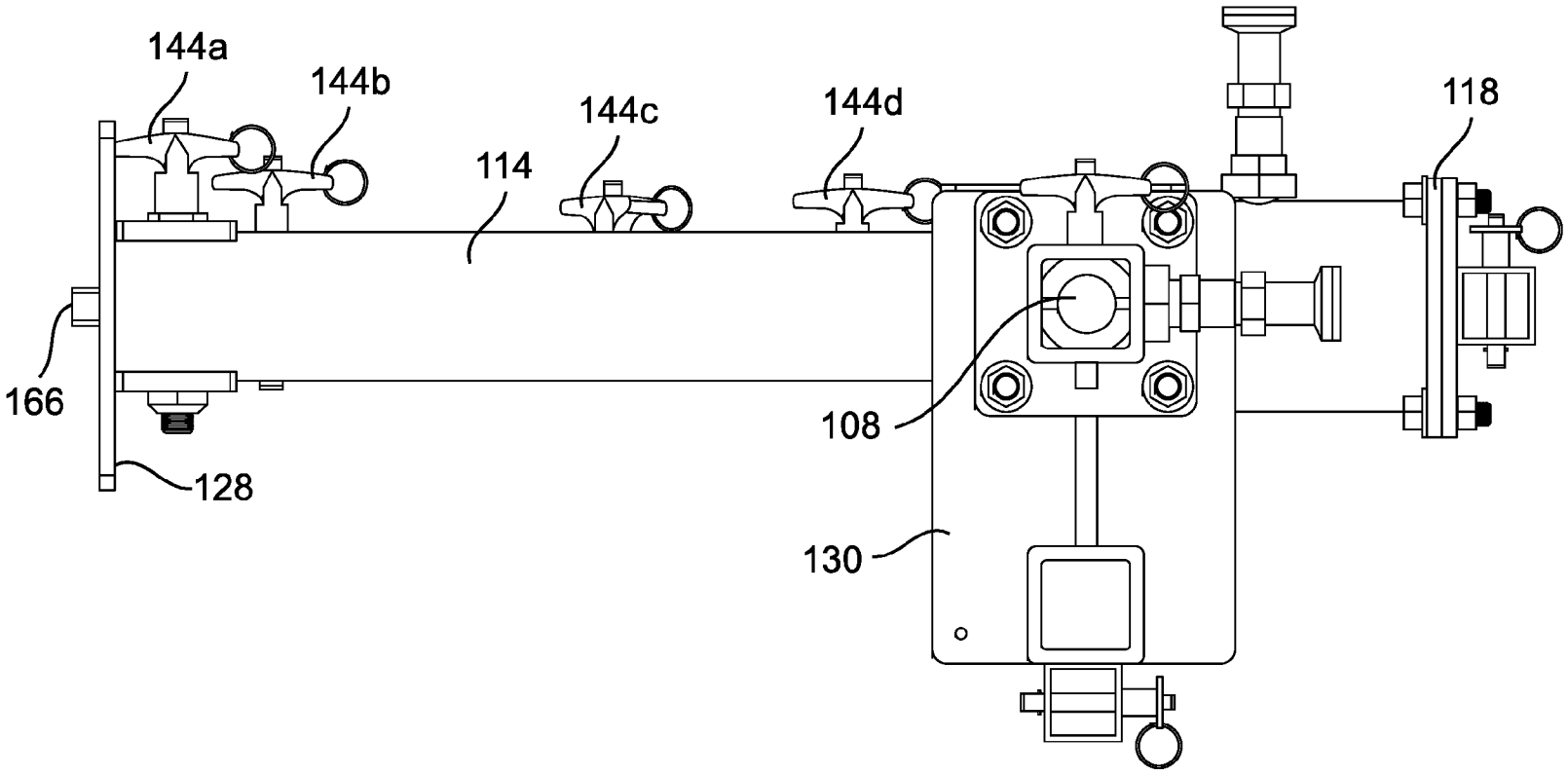
FIG. 9 illustrates a bottom view of a manhole cover moving assembly, in accordance with an embodiment of the present invention.

Turning now to FIG. 9, assembly 100 comprises a pulley apparatus 130 that joins with the shaft 114. In a non-limiting embodiment, a stainless pulley is attached to the top surface of shaft 114 by a quick disconnect pin. This allows for easy removal of the pulley to attach the extension attachment 168. Pulley apparatus 130 detachably attaches to the shaft 114, so that positioning along the length of shaft 114 may be employed for optimal mechanical advantage. Pulley apparatus 130 may include a wheel 132 that is rotatable about an axle 134. Pulley apparatus 130 is designed to guide movement and change of direction of a taut cable 136 along its circumference. Pulley apparatus 130 provides a mechanical advantage to lifting the manhole cover 202, as the load of the manhole cover is distributed on the axle and the cable.

A winch 154 is used to rotate wheel 132. The winch may include a mechanical rotating winch that creates a lever effect to further increase the mechanical advantage. Winch 154 may include a mechanical rotating winch that creates a lever effect to further increase the mechanical advantage. In one non-limiting embodiment, pulley apparatus 130 comprises a distal wheel 166 that is operational at the shaft terminus 118. Distal wheel 166 increases mechanical advantage by allowing cable 136 to extend to the furthest point of shaft 114.

As shaft 114 raises at a larger angle relative to mast 104, the angle between the two ends of cable 136 decreases, causing the force applied to the ends of the cable 136 from pulley apparatus 130 to decrease. This results in less weight being lifted. Conversely, as the shaft 114 lowers closer to the mast 104 at a smaller angle, the angle between the two ends of the cable increases, 144*a* causing the force applied to the ends of the cable from the pulley to increase. This results in greater weight being lifted.

For example, at 25° below an x-axis is about 110°, which lowers the load on the cables to a load angle factor of 1.15 instead of 1.87 while in the position of 45° above an x-axis, i.e., the mast 104. In another example, when shaft 114 is at a 40° angle above mast 104: 40°=1.87 angle factor (total load=tension (500 pounds)×angle factor (1.87)=935 pounds). In yet another example when shaft 114 is at a 110° above the mast 104, 110°=1.15 angle factor (total load=tension (500 pounds)×angle factor (1.15)=575 pounds). Thus, the angle of shaft 114 is manipulated to achieve different angles between the cables, which results in lower loads on the cable and easier lifting of the manhole cover.

Figure 11:
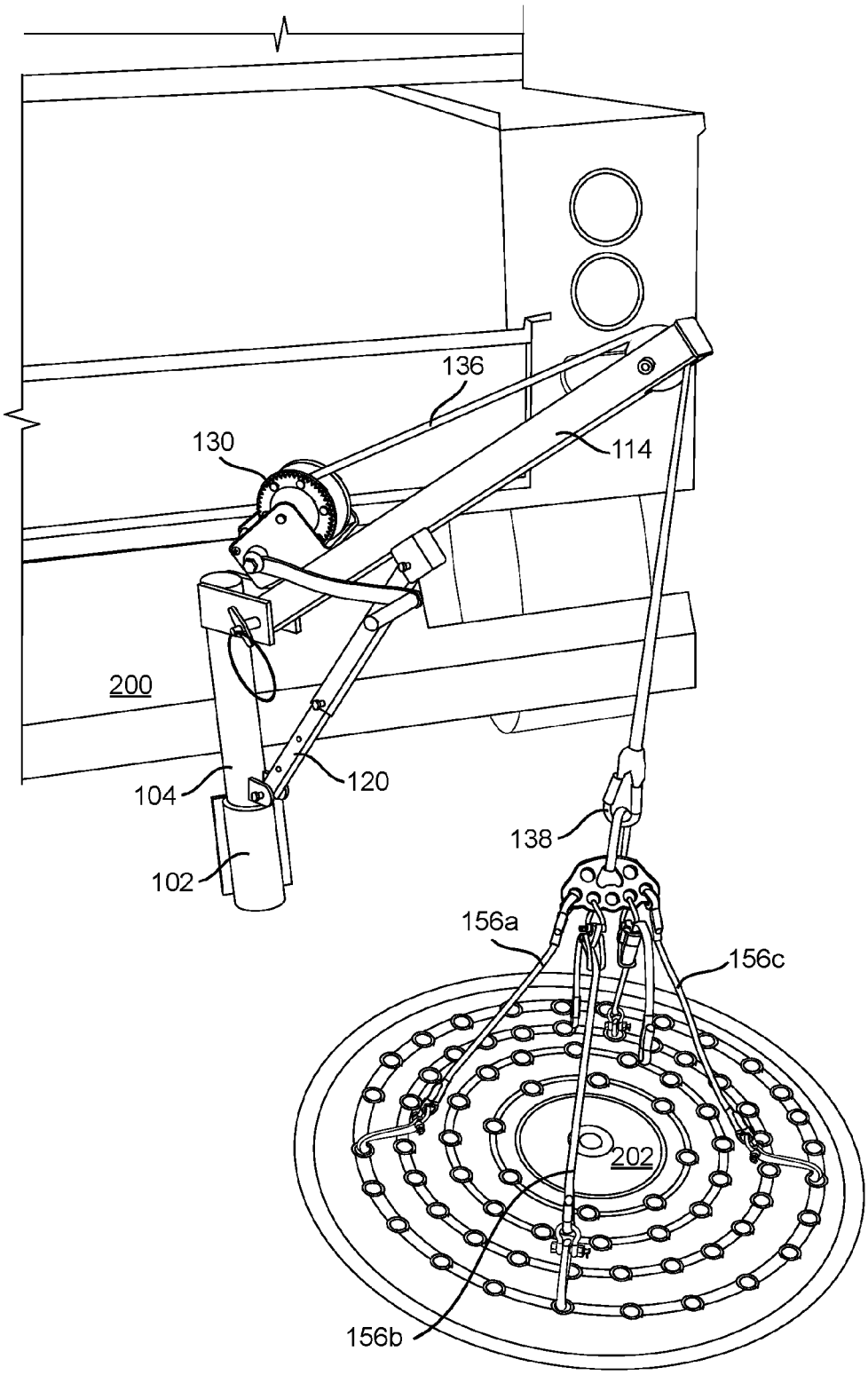
FIG. 11 illustrates a perspective view of a manhole cover moving assembly, showing the fastening mechanism attaching to a manhole cover, in accordance with an embodiment of the present invention.

Looking now at FIG. 11, manhole cover fastening mechanism 138 joins with a cable terminus 158 of the cable 136. Manhole cover fastening mechanism 138 is configured to detachably attach to manhole cover 202 through use of hooks, cables, and other fastening means known in the art of manhole covers. Manhole cover fastening mechanism 138 is configured to securely attach to and hold the manhole cover. In one embodiment, manhole cover fastening mechanism 138 comprises at least one cable and at least one hook. The number of cables in the manhole cover fastening mechanism 138 may be increased, and the angles between the lines changed to provide further mechanical advantage for lifting manhole cover 202.

Assembly 100 provides various types of manhole covering mechanisms. For example, manhole cover fastening mechanism 138 comprises a carabiner shackle. In other embodiments, at least one fastening cable 156*a*, 156*b*, 156*c* attaches to the manhole cover fastening mechanism 138. In one non-limiting embodiment, manhole cover fastening mechanism comprises a rigging plate 146. Rigging plate 146 is configured to lift a manhole cover using two fixed length cables 148*a*, 148*b* and two length adjustable cables 150*a*, 150*b*. At least one rigging plate hook 152*a*, 152*b*, 152*c*, 152*d* attaches to the two fixed length cables 148*a*, 148*b* and the two length adjustable cables 150*a*, 150*b*.

Figure 10:
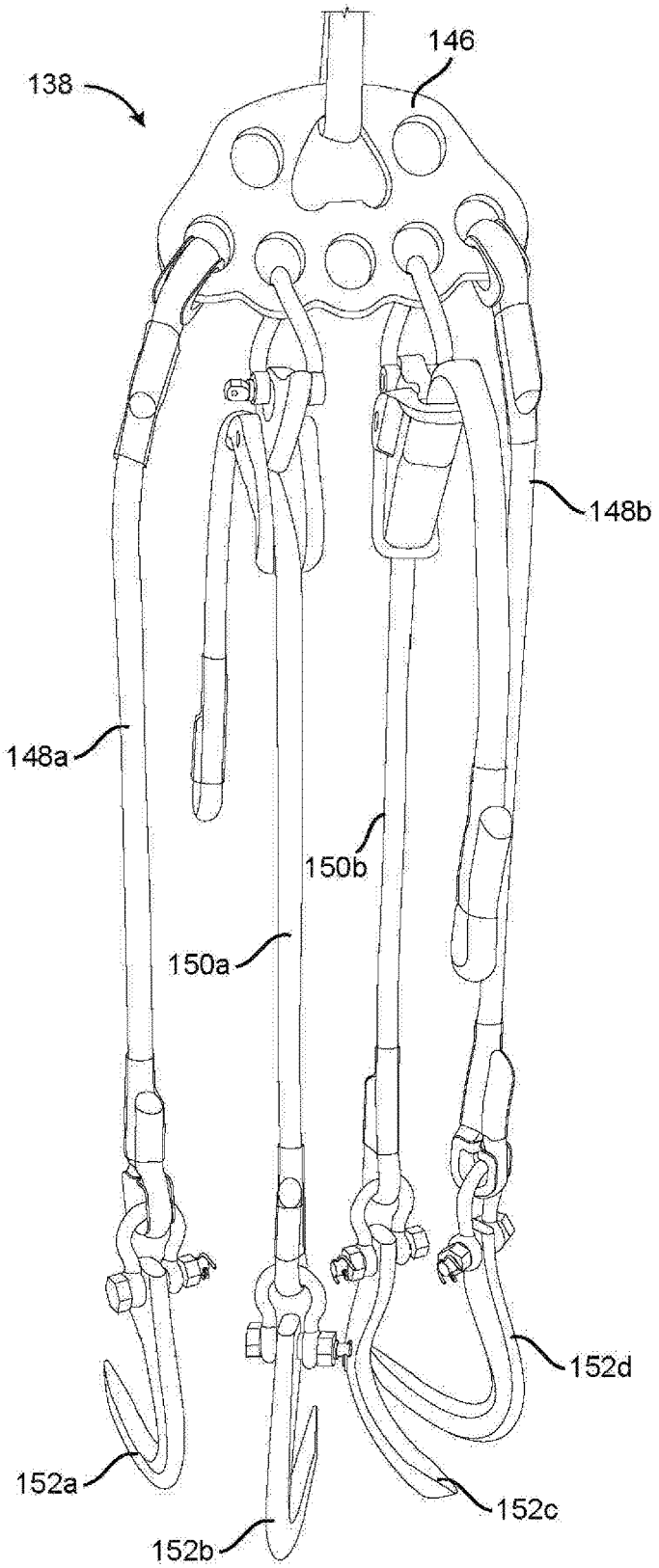
FIG. 10 illustrates a perspective view of an alternative form of a manhole cover fastening mechanism, showing a rigging plate, fixed cables, adjustable cables, and hooks for engaging the manhole cover, in accordance with an embodiment of the present invention.

One non-limiting embodiment of manhole cover fastening mechanism 138 that is shown in FIG. 10, is a rigging plate 146. Rigging plate 146 comprises fastening cables 148*a-b*, 150*a-b*, and rigging plate hooks 152*a-d* for carrying the manhole cover with more even weight distribution. Rigging plate 146 is generally elongated and has multiple receiving holes for receiving cable 136. The receiving holes in rigging plate are configured to create balance when lifting a heavy load, such as manhole cover.

Rigging plate 146 is configured to lift manhole cover 202 using two fixed length cables 148*a*, 148*b* and two length adjustable cables 150*a*, 150*b*. At least one hook 152*a*, 152*b*, 152*c*, 152*d* attaches to the two fixed length cables 148*a-b* and the two length adjustable cables 150*a-b*. This configuration allows an operator to lift the manhole cover flat without tipping side to side. The two fixed length cables 148*a-b* allow the operator to maintain the angle of the adjustable cables 150*a-b* from about 45° to 60°. This angle between cables 150*a-b* lowers the load on each individual cable 150*a-b*.

In operation, hitch 126 attaches assembly 100 to mobile mount 200. Mobile mount 200 is mobile and works to position assembly 100 proximal to the manhole cover, such that at least one hook is suspended over the manhole cover. The hook from the manhole cover fastening mechanism 138 engages preformed manhole cover holes. For changing the angle of shaft through length adjustment, telescoping support arm 120 is extended or retracted to change the angle of the shaft 114.

Figure 12:
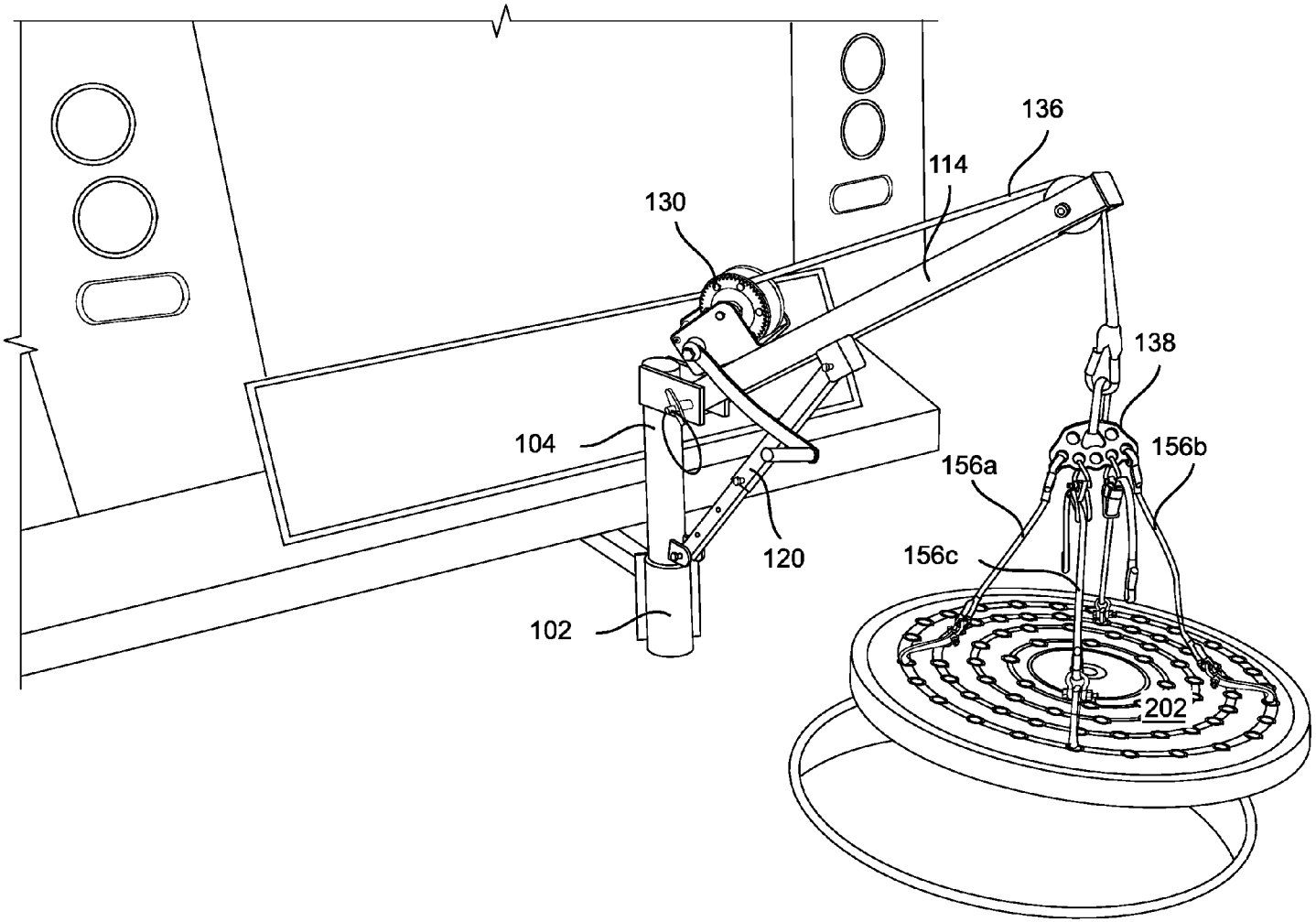
FIG. 12 illustrates a perspective view of a manhole cover moving assembly, showing the cable lifting the manhole cover, in accordance with an embodiment of the present invention.
Figure 13:
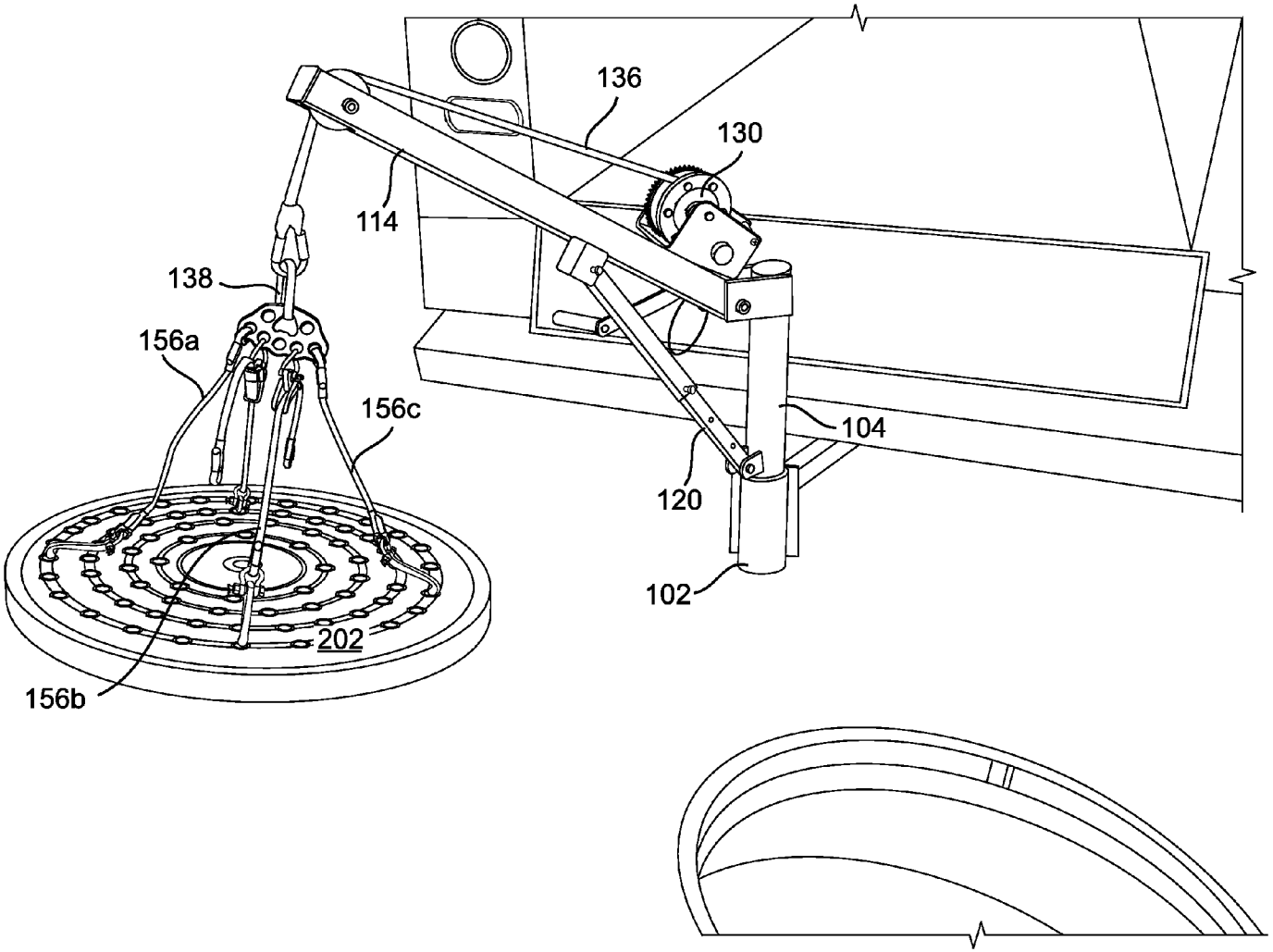
FIG. 13 illustrates a perspective view of a manhole cover moving assembly, showing the mast rotating to carry the manhole cover towards the mobile mount, in accordance with an embodiment of the present invention.

For changing the angle of shaft through angle adjustment, the hole 140 in telescoping support arm 120 is aligned with an aperture in shaft 114 to achieve a desired angle for shaft 114. The hook engages the manhole cover hole. The winch is operated to rotate the pulley, which retracts the cable, causing manhole cover 202 to be lifted from the manhole, as shown in FIG. 12. After lifting the manhole cover 202, mast 104 is rotated within sleeve 102 to carry the manhole cover 202 to mobile mount 200, such as a bed of a pickup truck (FIG. 13). Further, the angle of shaft 114 relative to mast 104, and the position of pulley apparatus 130 along shaft 114 dictates the mechanical advantage gained while lifting and rotating the manhole cover 202.

Figure 14:
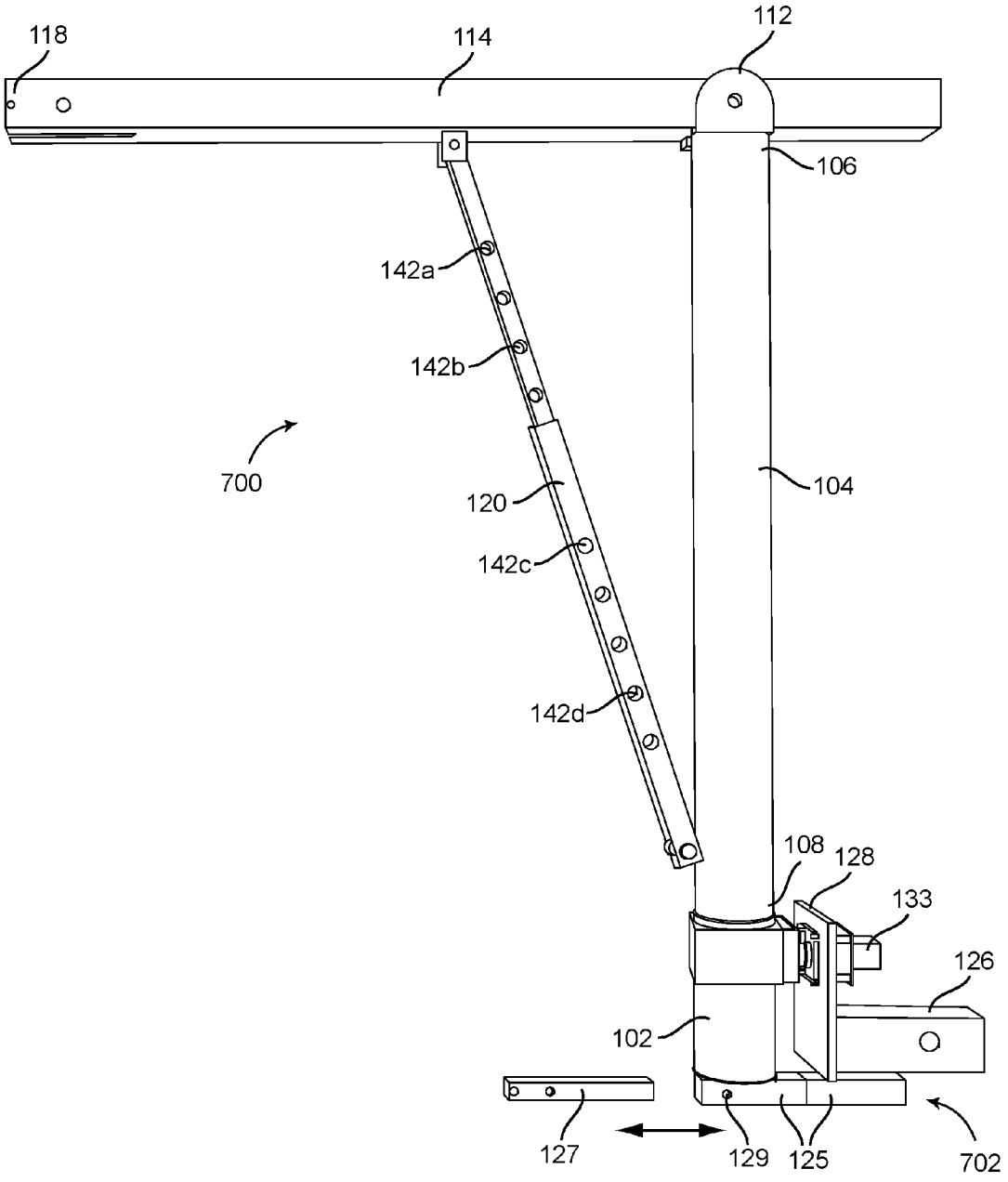
FIG. 14 illustrates a perspective view of an alternative manhole cover moving assembly having a hitching mechanism that uses a bridge and a fastening rod to connect the sleeve to the hitch, in accordance with an embodiment of the present invention.

FIG. 14 illustrates a perspective view of an alternative manhole cover moving assembly 700 having a unique hitching mechanism 702 that reinforces connection between vehicle and assembly 700. Hitching mechanism 702 that uses a bridge 125 and a fastening rod 127 to connect the sleeve 102 to the hitch 126. Bridge 125 is generally rigid, and extends between sleeve 102 to the hitch 126. Bridge 125 may be welded under sleeve 102 and hitch. Bridge 125 is configured to receive fastening rod 127. Bridge is configured to add strength to connection, and also to facilitate lifting of the manhole cover while lifting in the 180° range.

Figure 15:
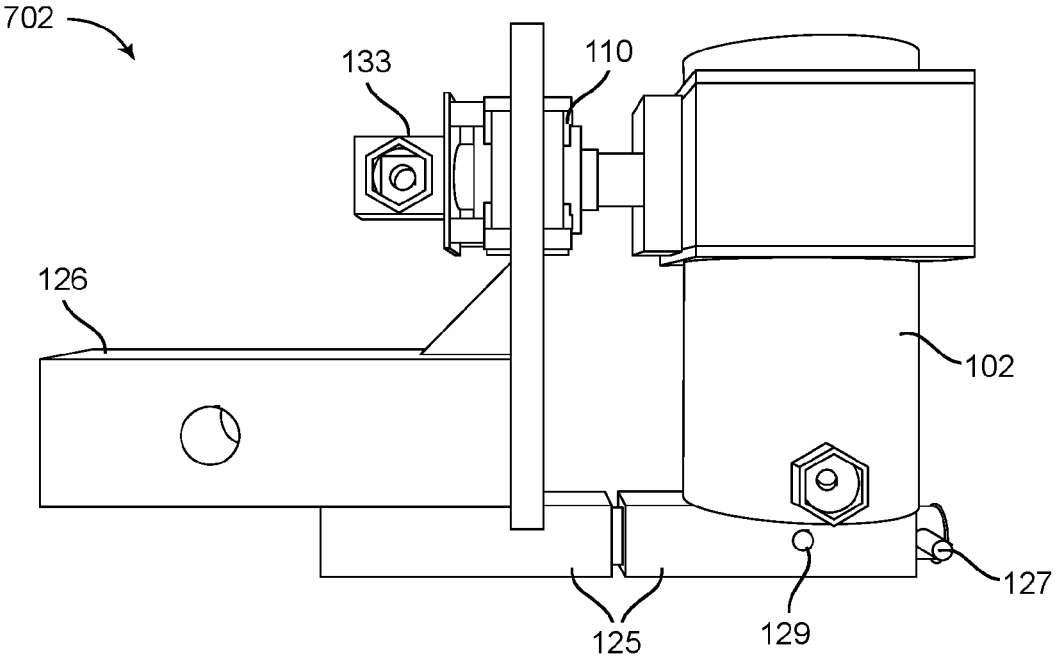
FIG. 15 illustrates a close up view of an alternative manhole cover moving assembly having a hitching mechanism that uses a bridge and a fastening rod to connect the sleeve to the hitch, in accordance with an embodiment of the present invention.

In some embodiments, bridge 125 may include at least one hitch fastening hole 129 that aligns with opening in fastening rod to enable a pin 135 to pass through. As FIG. 15 illustrates, hitch mechanism 702 may also include a secondary hitch fastener 133 that reinforces the connection between hitch 126 and the assembly 700.

Figure 16:
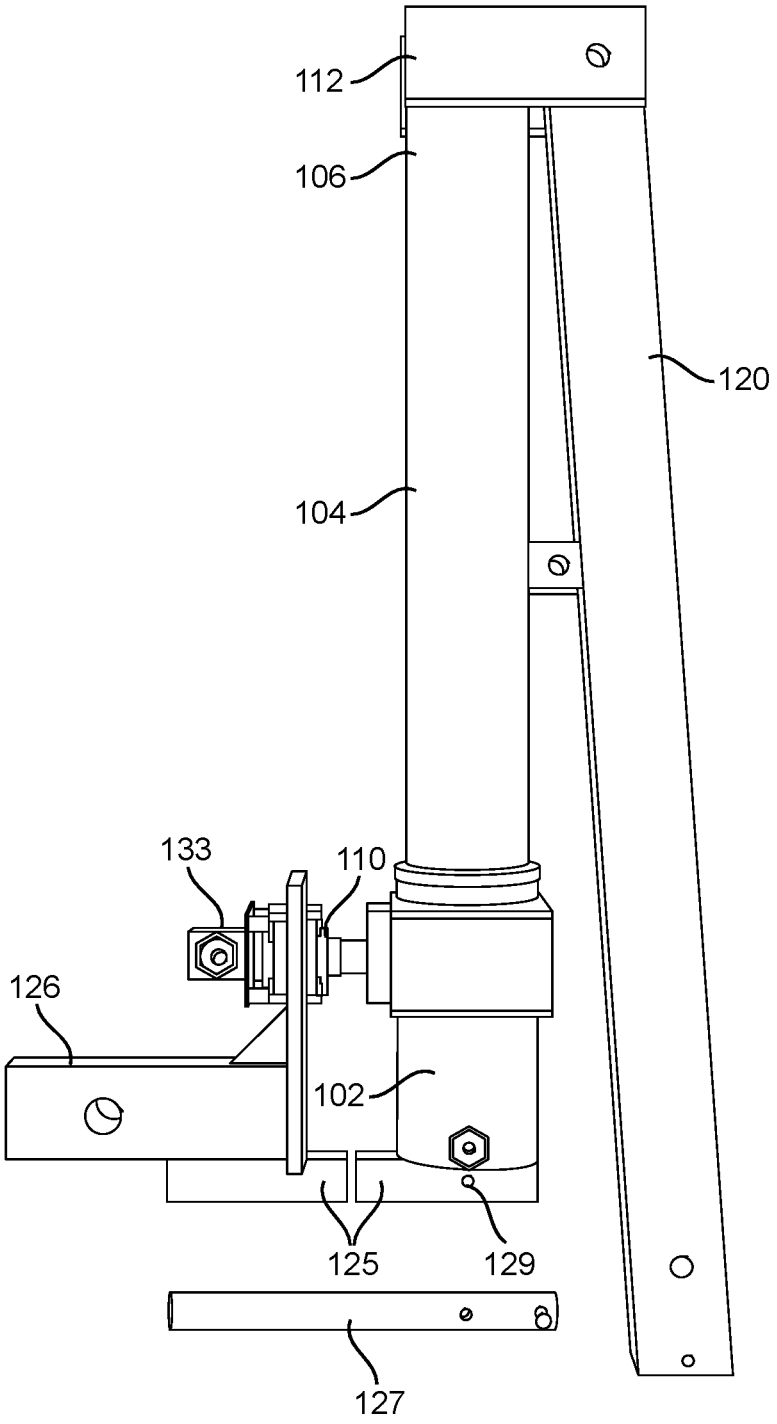
FIG. 16 illustrates a close up view of the hitching mechanism shown in FIG. 14, where the fastening rod is detached from the bridge, in accordance with an embodiment of the present invention.

FIG. 16 illustrates a close up view of the hitching mechanism 702 that is shown in FIG. 14, in a stored position. To achieve the stored position, telescoping support arm 120 is hingedly released from shaft 114 and swings freely in a parallel arrangement with shaft 114 about pivot member 112. In this embodiment, fastening rod 127 is detached from bridge 125. Bridge 125 and fastening rod 127 may have a generally square shape to enable a snug interconnection therebetween. Fastening rod 127 adds structural strength and stops lower end of sleeve 102 from moving towards hitch 126 and stops sleeve 102 from rotating while having a load lifted or while lifting.

Figure 17:
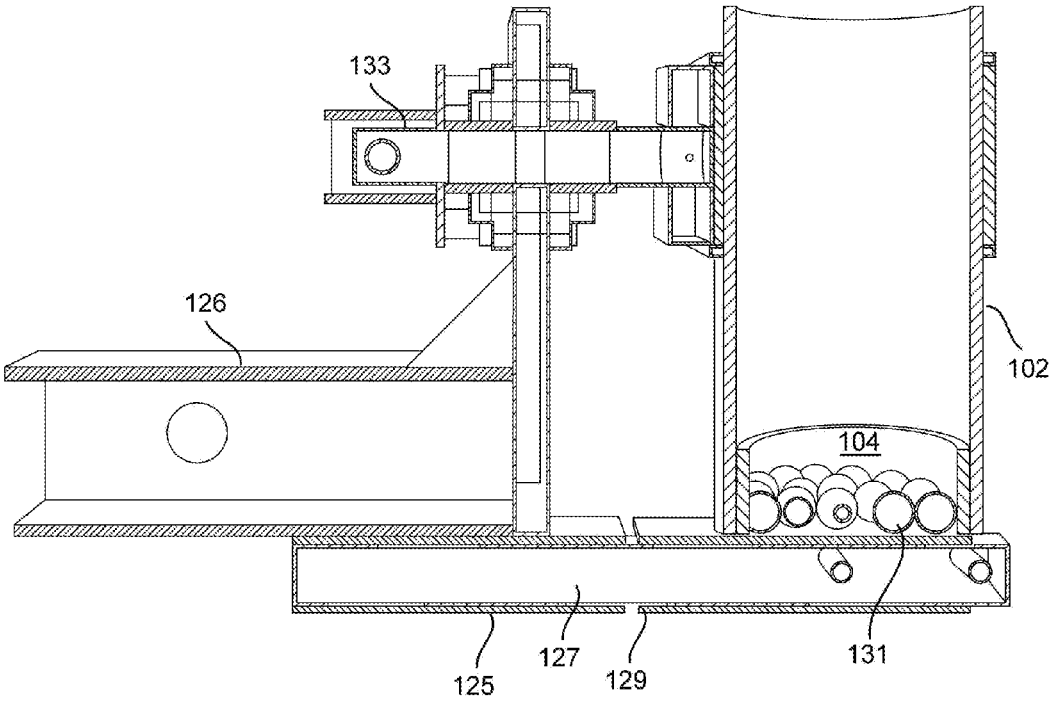
FIG. 17 illustrates a cross sectional view of the alternative manhole cover moving assembly, shown in FIG. 15, in accordance with an embodiment of the present invention.

FIG. 17 illustrates a sectioned view of a plurality of ball bearings 131 positioned inside the mast 104 of the alternative manhole cover moving assembly 700 shown in FIG. 14. Ball bearings 131 enable smooth articulation of the mast 104 while rotating about the sleeve. The ball bearings also serve as a counterbalance to the weight of the manhole cover 202 during movement. In other possibilities, the ball bearings 131 may be replaced by any weighted objects.

Figure 18:
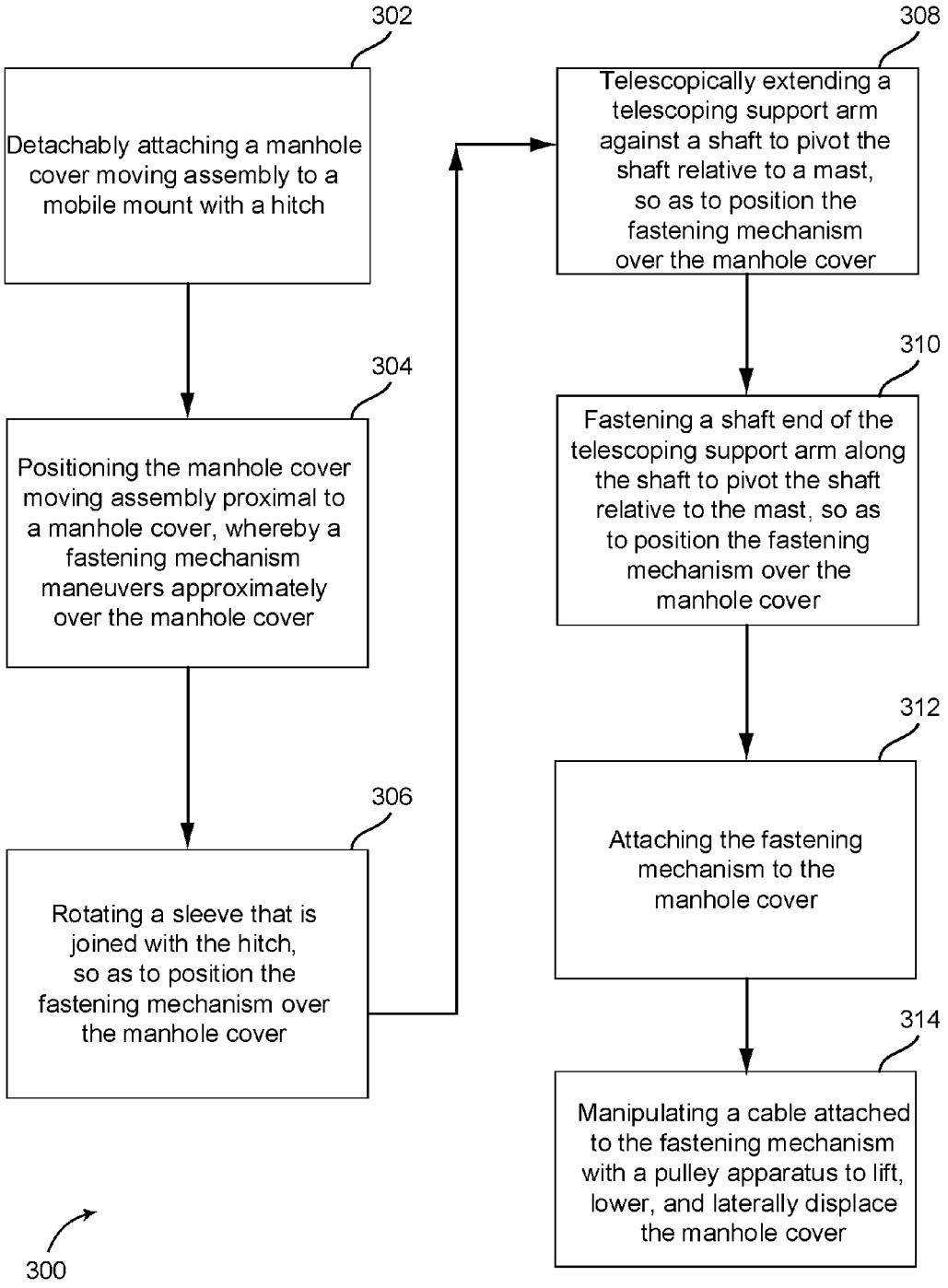
FIG. 18 illustrates a flowchart for an exemplary method for moving a manhole cover with a manhole cover moving assembly, in accordance with an embodiment of the present invention.

FIG. 18 illustrates a flowchart for an exemplary method 300 for moving a manhole cover with a manhole cover moving assembly. Method 300 may include an initial Step 302 of detachably attaching a manhole cover moving assembly 100 to a mobile mount 200 through a hitch 126. Hitch 126 detachably attaches assembly 100 to a mobile mount 200. Hitch 126 forms a hitch hole 160 through which various fasteners can pass to secure to mobile mount 200.

Method 300 may further comprise a Step 304 of positioning the manhole cover moving assembly proximal to a manhole cover, whereby a fastening mechanism maneuvers approximately over the manhole cover. A Step 306 includes rotating a sleeve that is joined with the hitch, so as to position the fastening mechanism over the manhole cover. In some embodiments, a Step 308 comprises telescopically extending a telescoping support arm against a shaft to pivot the shaft relative to a mast, so as to position the fastening mechanism over the manhole cover.

A Step 310 includes fastening a shaft end of the telescoping support arm along the shaft to pivot the shaft relative to the mast, so as to position the fastening mechanism over the manhole cover. Shaft 114 pivotally joins with upper end 106 of the mast 104. Pivot member 112 enables shaft 114 to pivot in an up-and-down motion relative to the mast 104. The angle of shaft 114 can be adjusted through various means to decrease the load on cables carrying the manhole cover. In some embodiments, a Step 312 may include attaching the fastening mechanism to the manhole cover. A final Step 314 comprises manipulating a cable attached to the fastening mechanism with a pulley apparatus to lift, lower, and laterally displace the manhole cover.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A manhole cover moving assembly, the assembly comprising:

a hitch;

a sleeve joined with the hitch;

a rotation member disposed between the hitch and the sleeve, the rotation member enabling the sleeve to rotate relative to the hitch;

a mast defined by a lower end and an upper end, the lower end of the mast coupled to the sleeve in a slidable relationship, whereby the mast rotates in the sleeve;

a shaft pivotally joined with the upper end of the mast, the shaft defined by a plurality of apertures disposed in a spaced-apart relationship along the length of the shaft;

a pivot member connecting the shaft to the upper end of the mast, the pivot member enabling the shaft to pivot in an up-and-down motion relative to the mast;

a telescoping support arm defined by a mast end, a shaft end, and a plurality of telescoping holes, the telescoping support arm disposed at an angle between the mast and the shaft, the telescoping support arm being telescopically extendable and retractable in length, whereby the length of the telescoping support arm at least partially dictates the sloped disposition of the shaft relative to the mast, the mast end of the telescoping support arm fixedly joined with the mast, the shaft end adjustably joined with the shaft at one of the apertures, whereby the selected aperture for joining with the shaft end at least partially dictates the sloped disposition of the shaft relative to the mast;

a fastener configured to pass through the selected aperture that forms in the shaft;

a pulley apparatus joined with the shaft, the pulley apparatus comprising a cable and a wheel rotatable about an axle, the wheel guiding the cable along the length of the shaft; and a manhole cover fastening mechanism joined with a cable terminus of the cable; wherein the manhole cover fastening mechanism comprises a rigging plate comprising two fixed length cables and two length adjustable cables.

2. The assembly of claim 1, wherein the hitch is detachably attachable to a mobile mount.

3. The assembly of claim 1, wherein the mast rotates in the sleeve between about 0 degrees to 180 degrees.

4. The assembly of claim 1, wherein the sleeve rotates relative to the hitch between about 0 degrees to 90 degrees.

5. The assembly of claim 1, wherein the shaft pivots relative to the mast between about 25 degrees to 45 degrees.

6. The assembly of claim 1, wherein the hitch forms a hitch hole.

7. The assembly of claim 1, wherein the lower end of the mast forms two lower mast holes.

8. The assembly of claim 1, further comprising a quick-release pin passing through the two lower mast holes and the hitch hole.

9. The assembly of claim 1, wherein the upper end of the mast forms an upper mast hole that aligns with one of the apertures that form in the shaft.

10. The assembly of claim 1, wherein the shaft is defined by a shaft terminus.

11. The assembly of claim 1, wherein the shaft terminus joins with an extension attachment that extends the length of the shaft about 3.5 feet.

12. The assembly of claim 1, wherein the shaft comprises a square steel tubing.

13. The assembly of claim 1, wherein the pulley apparatus comprises a distal wheel operational at the shaft terminus.

14. The assembly of claim 1, wherein the pulley apparatus detachably attaches to the shaft.

15. The assembly of claim 1, wherein the manhole cover fastening mechanism detachably attaches to a manhole cover.

16. The assembly of claim 1, wherein the rigging plate comprises at least one rigging plate hook detachably attachable to the two fixed length cables and the two length adjustable cables.

17. The assembly of claim 1, further comprising at least one fastening cable attached to the manhole cover fastening mechanism.

18. A manhole cover moving assembly, the assembly consisting of:

a hitch detachably attachable to a mobile mount, the hitch comprising a hitch plate, the hitch forming a hitch hole;

a sleeve joined with the hitch;

a rotation member disposed between the hitch and the sleeve, the rotation member enabling the sleeve to rotate relative to the hitch between about 0 degrees to 90 degrees;

a mast defined by a lower end and an upper end, the lower end being coupled to the sleeve in a slidable relationship, whereby the mast rotates in the sleeve between about 0 degrees to 180 degrees;

a shaft pivotally joined with the upper end of the mast, the shaft defined by a shaft terminus and a plurality of apertures disposed in a spaced-apart relationship along the length of the shaft;

an extension attachment extending from the shaft terminus;

a pivot member connecting the shaft to the upper end of the mast, the pivot member enabling the shaft to pivot in an up-and-down motion relative to the mast between about 25 degrees to 45 degrees;

a telescoping support arm defined by a mast end, a shaft end, and a plurality of telescoping holes, the telescoping support arm disposed at an angle between the mast and the shaft, the telescoping support arm being telescopically extendable and retractable in length, whereby the length of the telescoping support arm at least partially dictates the sloped disposition of the shaft relative to the mast, the mast end of the telescoping support arm fixedly joined with the mast, the shaft end adjustably joined with the shaft at one of the apertures, whereby the selected aperture for joining with the shaft end at least partially dictates the sloped disposition of the shaft relative to the mast;

a fastener configured to pass through the selected aperture that forms in the shaft;

a pulley apparatus joined with the shaft, the pulley apparatus comprising a cable and a wheel rotatable about an axle, the wheel guiding the cable along the length of the shaft; and a manhole cover fastening mechanism joined with a cable terminus of the cable, the manhole cover fastening mechanism comprising a rigging plate, the rigging plate comprising two fixed length cables, two length adjustable cables, and at least one rigging plate hook.

19. A method for moving a manhole cover with a manhole cover moving assembly, the method comprising:

detachably attaching a manhole cover moving assembly to a mobile mount with a hitch;

positioning the manhole cover moving assembly proximal to a manhole cover, whereby a fastening mechanism maneuvers approximately over the manhole cover;

rotating a sleeve that is joined with the hitch, so as to position the fastening mechanism over the manhole cover;

telescopically extending a telescoping support arm against a shaft to pivot the shaft relative to a mast, so as to position the fastening mechanism over the manhole cover;

fastening a shaft end of the telescoping support arm along the shaft to pivot the shaft relative to the mast, so as to position the fastening mechanism over the manhole cover;

attaching the fastening mechanism to the manhole cover; and manipulating a cable attached to the fastening mechanism with a pulley apparatus to lift, lower, and laterally displace the manhole cover; wherein the manhole cover fastening mechanism comprises a rigging plate comprising two fixed length cables and two length adjustable cables.

* * * * *